US010640992B2

(12) United States Patent
Awad et al.

(10) Patent No.: US 10,640,992 B2
(45) Date of Patent: May 5, 2020

(54) METHODS AND DEVICES RELATING TO GROUTING

(71) Applicant: A&A GROUT PUSHERS INC., Ottawa (CA)

(72) Inventors: Alexander Elias Awad, Ottawa (CA); Amin Tayseer Habib, Ottawa (CA)

(73) Assignee: A&A GROUT PUSHERS, INC., Ottawa (CA)

( * ) Notice: Subject to any disclaimer, the term of this patent is extended or adjusted under 35 U.S.C. 154(b) by 0 days.

(21) Appl. No.: 14/732,950

(22) Filed: Jun. 8, 2015

(65) Prior Publication Data

US 2019/0226216 A1 Jul. 25, 2019

Related U.S. Application Data

(60) Provisional application No. 62/008,670, filed on Jun. 6, 2014.

(51) Int. Cl.
*E04F 21/24* (2006.01)
*E04F 21/165* (2006.01)

(52) U.S. Cl.
CPC ..... *E04F 21/248* (2013.01); *E04F 21/165* (2013.01); *E04F 21/245* (2013.01)

(58) Field of Classification Search
CPC ..... E04F 21/248; E04F 21/245; E04F 21/20; E04F 21/24; E04F 21/241; B05C 11/023; B05C 11/028; B05C 11/04; B05C 11/045; A47L 13/02; A47L 13/10; A47L 13/11; A47L 13/16; A47L 13/28
See application file for complete search history.

(56) References Cited

U.S. PATENT DOCUMENTS 2,556,983 A * 6/1951 Root ..... E04F 21/248 404/112
5,314,100 A * 5/1994 Deaver ..... B28C 5/1223 222/236
5,372,452 A * 12/1994 Hodgson ..... E04F 21/248 404/112
5,449,406 A * 9/1995 Presti, Jr. ..... E04F 21/248 118/244
6,260,743 B1 * 7/2001 Mazzenga ..... E04F 21/165 118/313

* cited by examiner

*Primary Examiner* — David J Walczak
(74) *Attorney, Agent, or Firm* — Rosenberg, Klein & Lee

(57) ABSTRACT

Grouting tiles and/or mosaics today even for large areas such as commercial environments, offices, shopping malls, etc. is achieved using professionals who work through the entire process on their hands and knees. It would be beneficial to provide building contractors, individuals, etc. with a machine to implement some or all of these steps thereby allowing a wider range of tiles and tile effects to be implemented. Equally a handheld unit may be employed by amateurs such as when decorating residential environments in order to improve the quality of their work and reduce the time taken. Such devices according to embodiments of the invention allowing use of smaller tiles, tiling mosaics, etc. without the costs of these visually effective and attractive designs being prohibitive.

20 Claims, 14 Drawing Sheets

METHODS AND DEVICES RELATING TO GROUTING

CROSS-REFERENCE TO RELATED APPLICATIONS

This patent application claims the benefit of U.S. Provisional Patent Application 62/008,670 filed Jun. 6, 2014 entitled "Methods and Devices relating to Grouting", the entire contents of which are incorporated herein by reference.

FIELD OF THE INVENTION

This invention relates to grouting and more particularly to machines for applying grout.

BACKGROUND OF THE INVENTION

Grout is a construction material used to embed rebars in masonry walls, connect sections of pre-cast concrete, fill voids, and seal joints. For most individuals the latter represents their general exposure to grout as it is used to seal the joints between tiles in their homes such as within bathrooms, kitchens, and floors. Grout is generally a mixture of water, cement, and sand with often a colour tint added. Sometimes fine gravel is added if it is being used to fill the cores of concrete blocks. It is typically applied as a thick emulsion and hardens over time, much like its close relative mortar.

The main varieties include:

- urethane tiling grout, which cures to a hard, self-sealing, semi-elastic finish;
- cement tiling grout, which is low cost, easier to work, and may be buffed off;
- epoxy tiling grout, which has good stain and chemical resistance but has short working time and cured epoxy is hard to remove;
- flooring grout;
- resin grout, which is typically water repelling;
- non-shrink grout, which is a hydraulic cement grout expanding upon curing and particularly suited to load bearing members;
- structural grout, which is typically in reinforced masonry to fill voids in masonry housing reinforcing steel; and
- thixotropic grout, which is typically injected to fill voids or bond metal components into place.

Tiling grout is often used to fill the spaces between tiles or mosaics, and to secure the tiles to the base they are being installed upon. There are several tools typically associated with applying grout such as:

- grout float a trowel-like tool for smoothing the surface of a grout line, typically made of rubber or soft plastic; and
- pointing trowel used for applying grout in flagstone, and other stone works.

When grouting joints narrow than 1/16" (approximately 1.5 mm), typically on walls and countertops in most residential settings then a non-sanded grout may be employed. For grouting joints wider than 1/16" (approximately 1.5 mm), typically on floors, then generally a sanded grout is employed which gives extra strength to keep it from cracking. Typically, a grouter will work in small areas. Once, mixed (when considering a sanded cement grout for example) then a grout float, generally padded for tiles, is used to spread the grout over the tiles and force it into the joints, see first image 150A in FIG. 1A. For wall applications it is usually scooped up from the bucket with the short side of the float. Once the grout float is used to spread the grout across the whole surface of the area with the long side of the float then the grouter will typically use both hands on the float to push it down into the joints, see second image 150B in FIG. 1A. All the time they are on their hands and knees.

Once, the area is finished, typically 3' wide by 2' deep (approximately 1 m by 0.7 m) then the grouter will hold the long edge of the float almost perpendicular to the floor and scrape the excess grout off the surface of the tiles. At this point it is important that they are sweeping diagonally to the joints so that the float is always running along the surface of the tiles and not accidentally digging the grout out of the joints.

Once this spread-smush-and-scrape phase is complete then judgment must be used about how long to continue working before going back to clean off the surface of the tiles as it needs to have time to harden but not so long that the residue on the surface of the tiles gets too hard to clean off. Typically, this is done by individuals by hand using a water and a soft, thick sponge for cleaning off the grout, see third image 150C in FIG. 1A. Again, during this cleaning the individual is on their hands and knees.

Accordingly, today grouting even where it is for large areas such as commercial environments, offices, shopping malls, etc. is achieved using professionals who work through the entire process on their hands and knees. Generally, because of this larger areas being tiled tend to be tiled with larger tiles. Accordingly, it would be beneficial to provide building contractors, individuals, etc. with a machine to implement some or all of these steps thereby allowing a wider range of tiles and tile effects to be implemented when tiling large areas including employing smaller tiles, tiling mosaics, etc. without the costs of these visually effective and attractive designs being prohibitive. Such a machine would also beneficially reduce the amount of time the worker is working on their hands and knees.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations in the prior art relating to grouting and more particularly to machines for applying grout.

In accordance with an embodiment of the invention there is provided a device comprising:

- a first motor;
- a drive mechanism for coupling a drive shaft of the first motor to a grouter drive assembly;
- a first grouter assembly coupled to the drive mechanism to distribute and direct a predetermined material into a surface with which the grouter assembly is in contact; and
- an auger for feeding the predetermined material from a hopper to be dispensed in predetermined position relative to the first grouter assembly, the auger coupled to at least one of the first motor and a second motor via an auger drive assembly.

In accordance with an embodiment of the invention there is provided a method of grouting a surface comprising a plurality of tiles or mosaics using a machine having a number of rotating grouter assemblies, each grouter assembly comprising a plurality of deformable floats that direct and force grout into the gaps between the plurality of tiles or mosaics.

In accordance with an embodiment of the invention there is provided a floor supported device for grouting a surface comprising a plurality of tiles or mosaics using a machine having a number of rotating grouter assemblies, each grouter assembly comprising a plurality of deformable floats that direct and force grout into the gaps between the plurality of tiles or mosaics.

In accordance with an embodiment of the invention there is provided a handheld device for grouting a surface comprising a plurality of tiles or mosaics using a machine having a number of rotating grouter assemblies, each grouter assembly comprising a plurality of deformable floats that direct and force grout into the gaps between the plurality of tiles or mosaics.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

The present invention is directed to grouting and more particularly to machines for applying grout.

The ensuing description provides exemplary embodiment(s) only, and is not intended to limit the scope, applicability or configuration of the disclosure. Rather, the ensuing description of the exemplary embodiment(s) will provide those skilled in the art with an enabling description for implementing an exemplary embodiment. It being understood that various changes may be made in the function and arrangement of elements without departing from the spirit and scope as set forth in the appended claims.

"Grout" as used herein and throughout this disclosure, refers to a material employed within various narrow cavities, as masonry joints, wall tile joints, mosaics, and floor tile joints for example, to fill them and consolidate the adjoining objects into a solid assembly. This includes, but is not limited to, mortar, sanded grout, unsanded gout, furan grout, urethane tiling grout, cement tiling grout, epoxy tiling grout, flooring grout, resin grout, non-shrink grout, structural grout, and thixotropic grout.

Figure 1A:
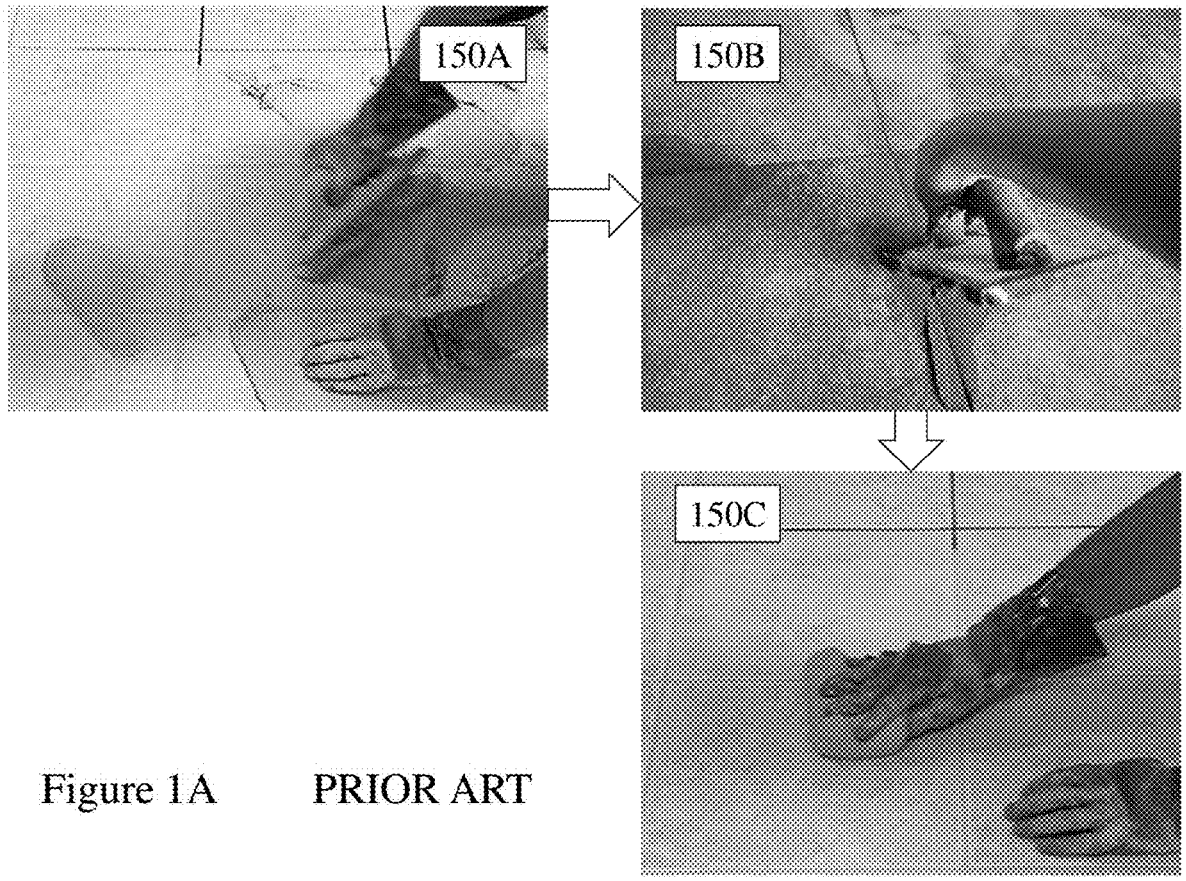
Figure 1A PRIOR ART
FIG. 1A depicts applying grout to flooring tiles according to the prior art.
Figure 1B:
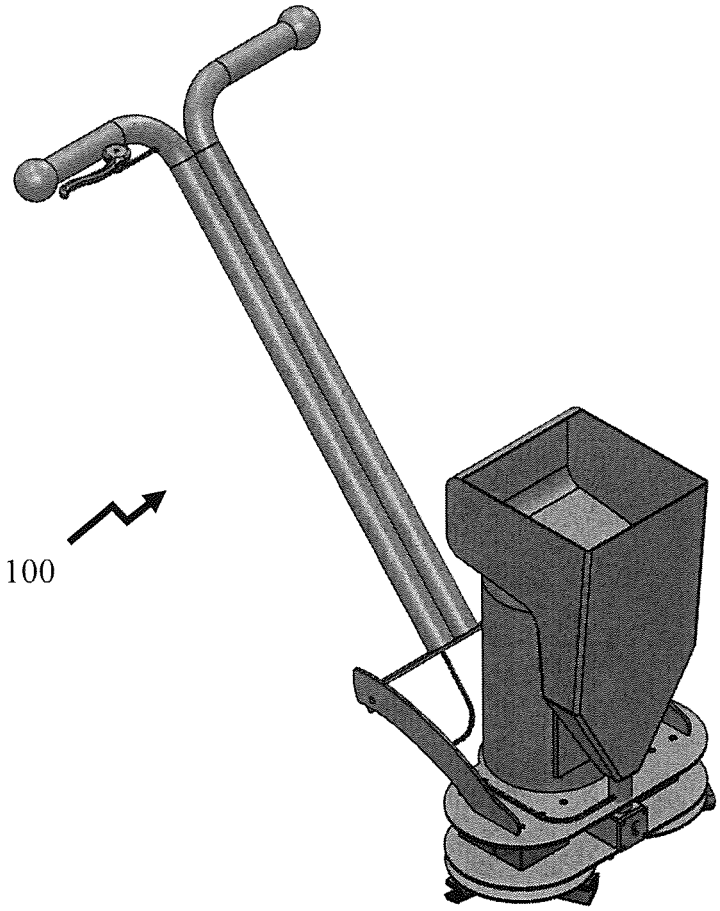
FIGS. 1B and 1C depict a grouting machine according to an embodiment of the invention.
Figure 1C:
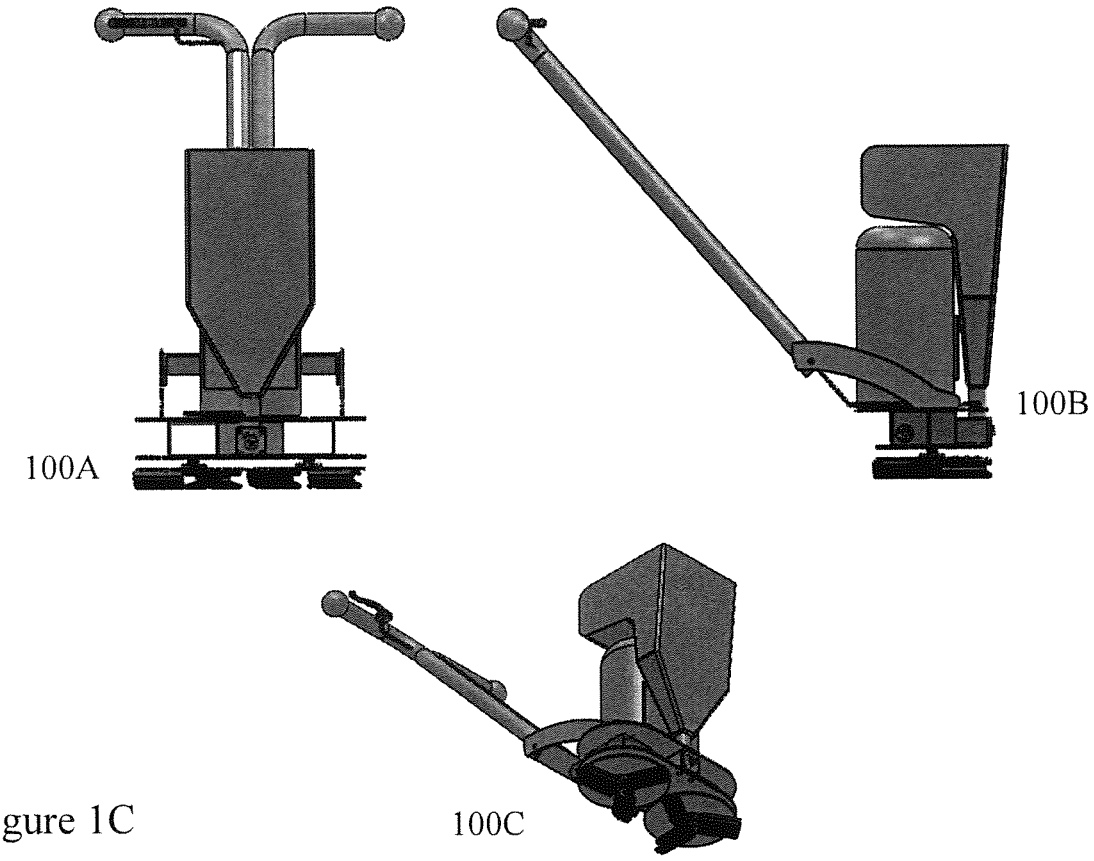

Referring to FIG. 1B there is depicted a perspective image of a grouting machine 100 according to an embodiment of the invention. As will be described below in respect of FIGS. 2 through 6B the grouting machine 100 allows a user to grout flooring without the prior art requirements of manually performing the grout spreading application and pressure applications on their hands and knees. The user fills the hopper with mixed grout, holds the machine in a working position, turns on the machine and dispenses the grout as desired. The user steers the machine to direct the grout via floats over the tile crevices and the grout is pushed down between them, leaving them filled. The user can control the amount of grout dispensed and when it is dispensed. Referring to FIG. 1C front, side, and bottom perspective views of the grouting machine 100 according to an embodiment of the invention.

Figure 2:
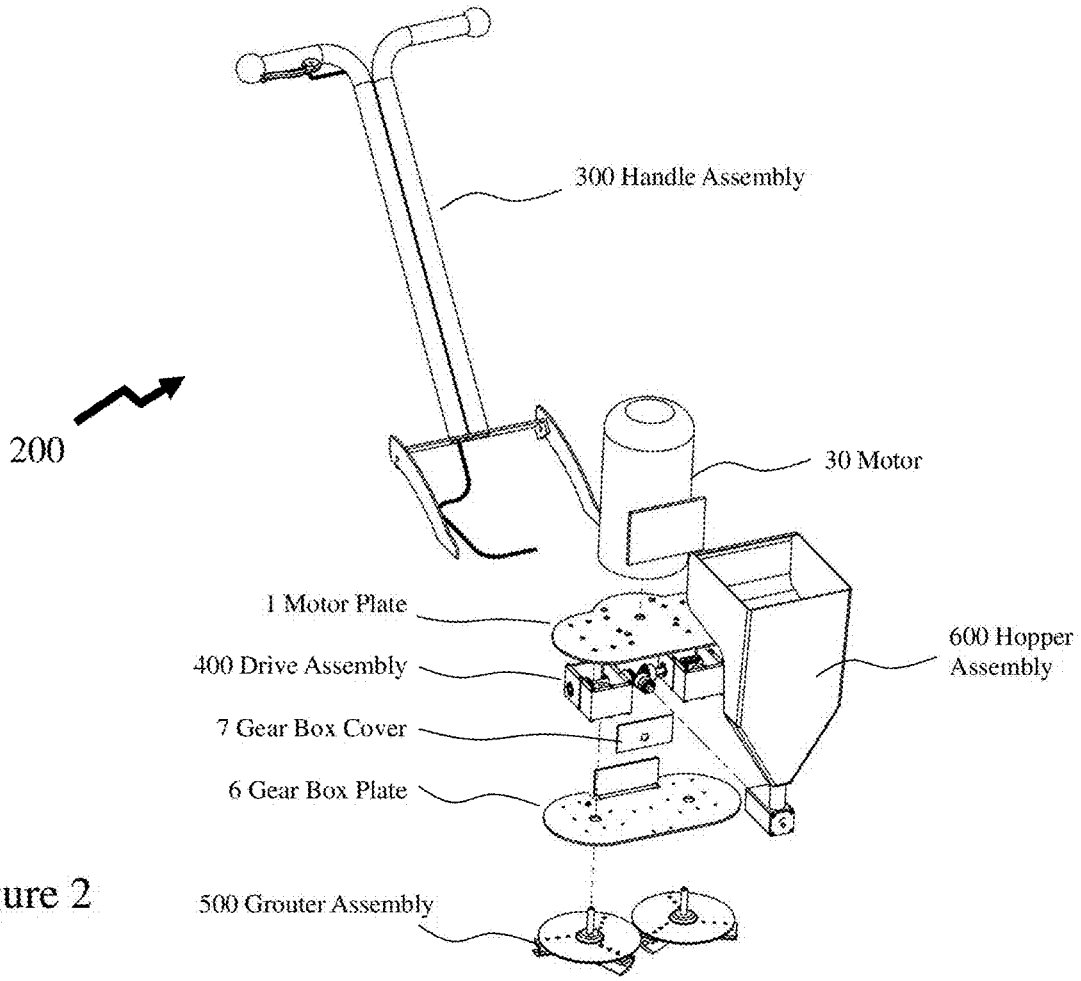
FIG. 2 depicts an exploded assembly schematic for a grouting machine according to an embodiment of the invention.

Now referring to FIG. 2 there is depicted an exploded assembly schematic 200 for the grouting machine 100 according to an embodiment of the invention. As depicted the grouting machine 100 comprises a handle assembly 300 which is connected to motor plate 1 upon which a motor 30 is mounted. Disposed below the motor plate 1 is drive assembly 400 which couples to grouter assemblies 500 and hopper assembly 600. Disposed between the drive assembly 400 and grouter assemblies 500 is gear box plate 6. Accordingly, rotary motion of a drive shaft of the motor 30 is coupled via the drive assembly 400 to an auger, not shown for clarity, within the hopper assembly 600 to push the grout out of the grouting machine 100 and via gear boxes, not identified for clarity, within the drive assembly 400 to the grouter assemblies 500 that spread and press the grout across the tiles and into the joints. In other embodiments of the invention the auger may be driven through an auger drive mechanism which is driven by a separate motor to that driving the drive assembly 400 and motor plate 1.

Figure 3:
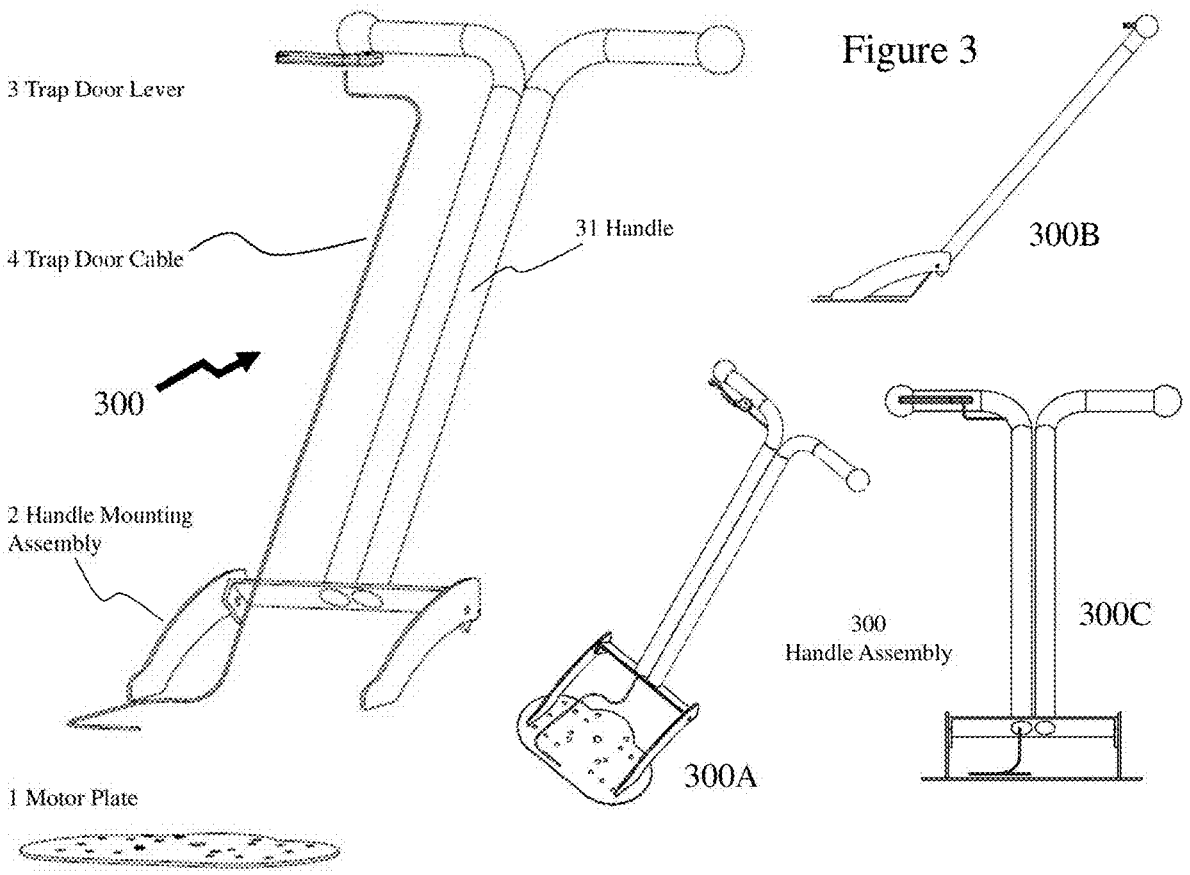
FIG. 3 depicts a handle assembly for a grouting machine according to an embodiment of the invention.

Referring to FIG. 3 there is depicted an exploded view of handle assembly 300 for a grouting machine 100 according to an embodiment of the invention together with the motor plate 1 to which it attaches. The mounting of handle assembly 300 to motor plate 1 being via handle mounting assemblies 2 which may, according to embodiments of the invention be demountably attached (e.g. via nuts and bolts or threaded fasteners to threads within the motor plate 1) or non-demountably attached (e.g. welded). Handle 31 is also attached to handle mounting assemblies 2 which may, according to embodiments of the invention be demountably attached (e.g. via nuts and bolts or threaded fasteners to threads within the handle mounting assemblies 2) or non-demountably attached (e.g. welded). The handle mounting assemblies 2 may house electronics and motor control means. Attached to a handle element of handle 31 is a switch for activation of a motor coupled to the auger via an auger drive mechanism within the hopper assembly 600, not shown for clarity, such, that the operator/user can control the amount of grout dispatched from the hopper assembly 600, not shown for clarity. Also depicted in FIG. 3 are first view 300A, second view 300B, and third view 300C of the handle assembly 300 with motor plate 1 attached in upper perspective, side, and front views respectively.

It would be evident to one skilled in the art that other designs of the handle assembly 300 may be provided without departing from the scope of the invention including, but not limited to, a single central bar with a handle attached at the top, auger motor activation switch and wiring as external or internal to the central bar of handle, etc. The materials for the handle assembly may include, but not be limited, one or more of steel, stainless steel, aluminum, fiber reinforced plastic, plastic, etc. according to the design of the overall grouting machine 100 as discussed below which may vary from a small handheld unit to medium floor units and large floor units for example. It would also be evident that according to the design of the other elements of the grouting machine 100 that the handle mounting assembly 2 and/or handle 31 may also be varied to adjust to variations in the design of the motor plate 1 or other elements of the grouting machine 100 to which the handle assembly 300 fits and may be permanently, removably and/or pivotally attached together using techniques known in the art.

Figure 4A:
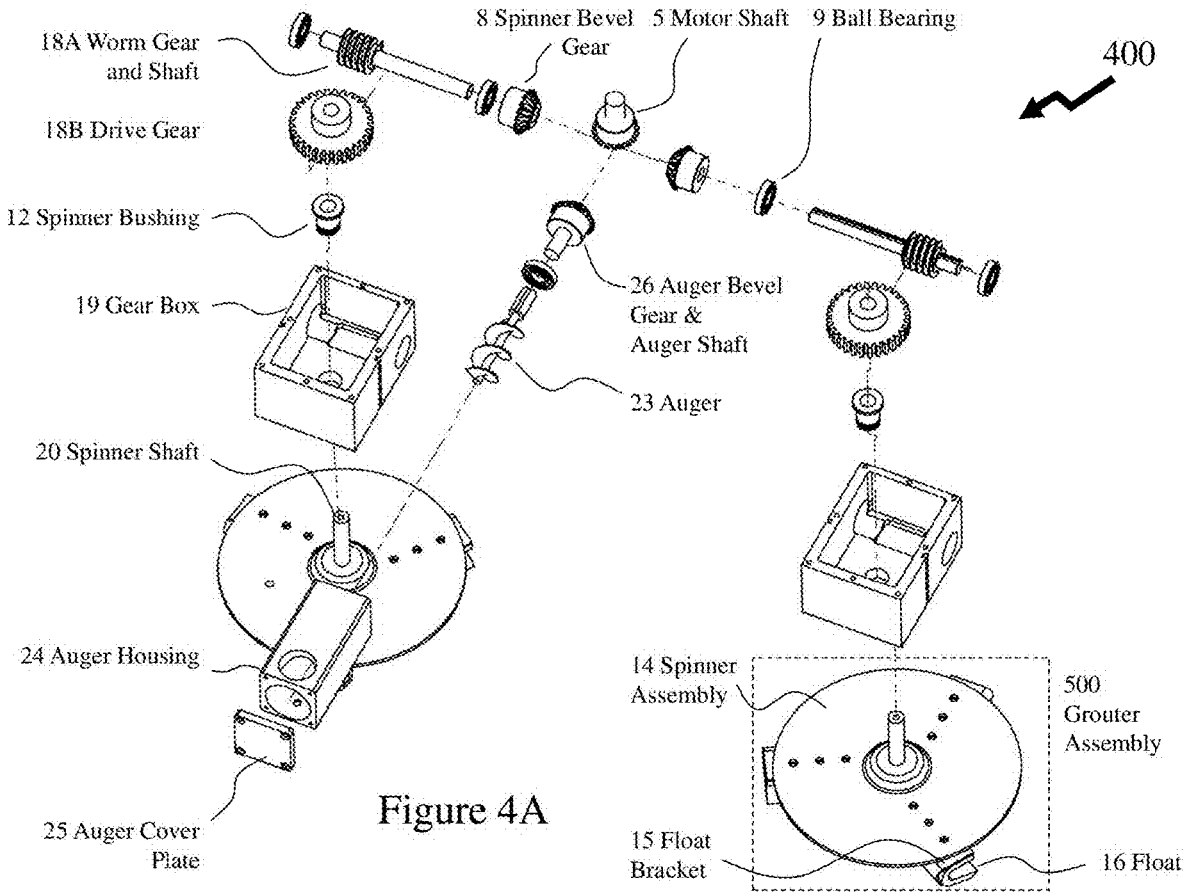
FIG. 4A depicts an exploded drive assembly schematic for a grouting machine according to an embodiment of the invention.
Figure 4B:
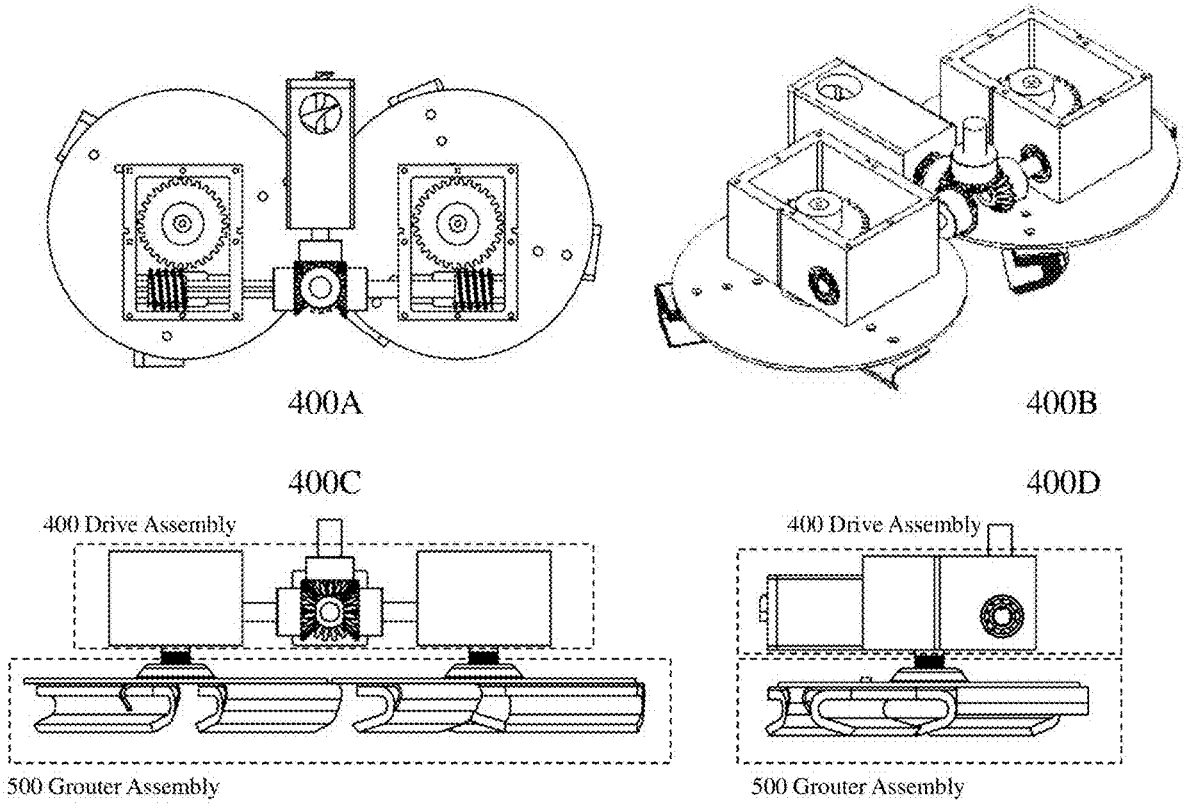
FIG. 4B depicts different views of the drive and grouting assembly portions of a grouting machine according to an embodiment of the invention.

Now referring to FIG. 4A there is depicted an exploded drive assembly 400 schematic for a grouting machine 100 according to an embodiment of the invention. In the embodiment depicted for the drive assembly 400 schematic two grouter assemblies 500 are depicted although it would be evident to one skilled in the art and as described below in respect to variants of the invention that different numbers of grouter assemblies 500 may be coupled to a single drive assembly and/or motor. Accordingly, one, two, three, four or more grouter assemblies may be coupled to a drive assembly. As depicted each grouter assembly 500 comprises a spinner plate 14 below which are attached float brackets 15 and floats 16 such as described below in respect of FIGS. 5A and 5B respectively. Each grouter assembly 500 further comprises a spinner shaft 200 which engages with a spinner bushing 12 allowing the spinner shaft 20 to be fed through the base of a gear box 19 and be coupled to drive gear 18B. Drive gear 18B is then coupled via worm gear and drive shaft 18A to spinner bevel gear 8 and therein motor shaft 5. As depicted a pair of such grouter assemblies 500 and associated drive train/gear boxes 19 are symmetrically disposed with respect to the motor shaft 5. Also coupled to motor shaft 5 is auger bevel gear and auger shaft 26 which are coupled to auger 23 although in other embodiments of the invention the auger may be driven from a separate motor via a separate auger drive train mechanism. Auger 23 fits within auger housing 24 which closed with auger cover plate 25 and comprises an upper opening, which couples to the hopper assembly 600 (not shown for clarity) to receive grout, and a lower opening through which the auger pushes the grout received from the hopper assembly 600.

Optionally, gearbox 19 and drive gear 18B may provide the operator of the grouting machine 100 with a predetermined set of gear ratios, a single gear ratio, or a continuously variable gear ratio according to embodiments of the invention determined in dependence upon desired rotation rate(s) of the grouter assemblies 500 and the operating speed range(s) of the motor (not shown for clarity). Optionally, each gear box 19 may also contain a clutch allowing the drive to be selectively coupled without starting/stopping the motor. It would be evident that drive assembly 400 schematic may be easily modified to provide three spinner assemblies 500 by providing the third grouter assembly 500 opposite the auger assembly. It would also be evident that a drive assembly 400 schematic with four grouter assemblies 500 and two auger assemblies feeding pairs of grouter assemblies 500 may be implemented by mirroring the depicted drive assembly 400 schematic with an additional gear assembly coupled to the motor shaft driving each drive assembly 400 schematic, Optionally, multiple grouter assemblies 500 may be coupled via a single gear box or in other embodiments of the invention according to the characteristics of the motor (not shown for clarity) coupled directly to the motor shaft 5.

Optionally, a gear box and/or clutch and/or potentiometer may also be provided on the auger drive assembly so that the speed of grout dispensing may be adjusted independent of the speed of the spinner assemblies 500. Now referring to FIG. 4B there are depicted different views of the assembled drive assembly 400 schematic depicted in FIG. 4A together with the spinner assemblies for the drive and grouting assembly portions of a grouting machine 100 according to an embodiment of the invention. These views being:

Plan view 400A;

Upper perspective view 400B,

Rear elevation 400C looking towards the motor shaft 5 opposite the auger assembly; and Side elevation 400D.

Figure 5A:
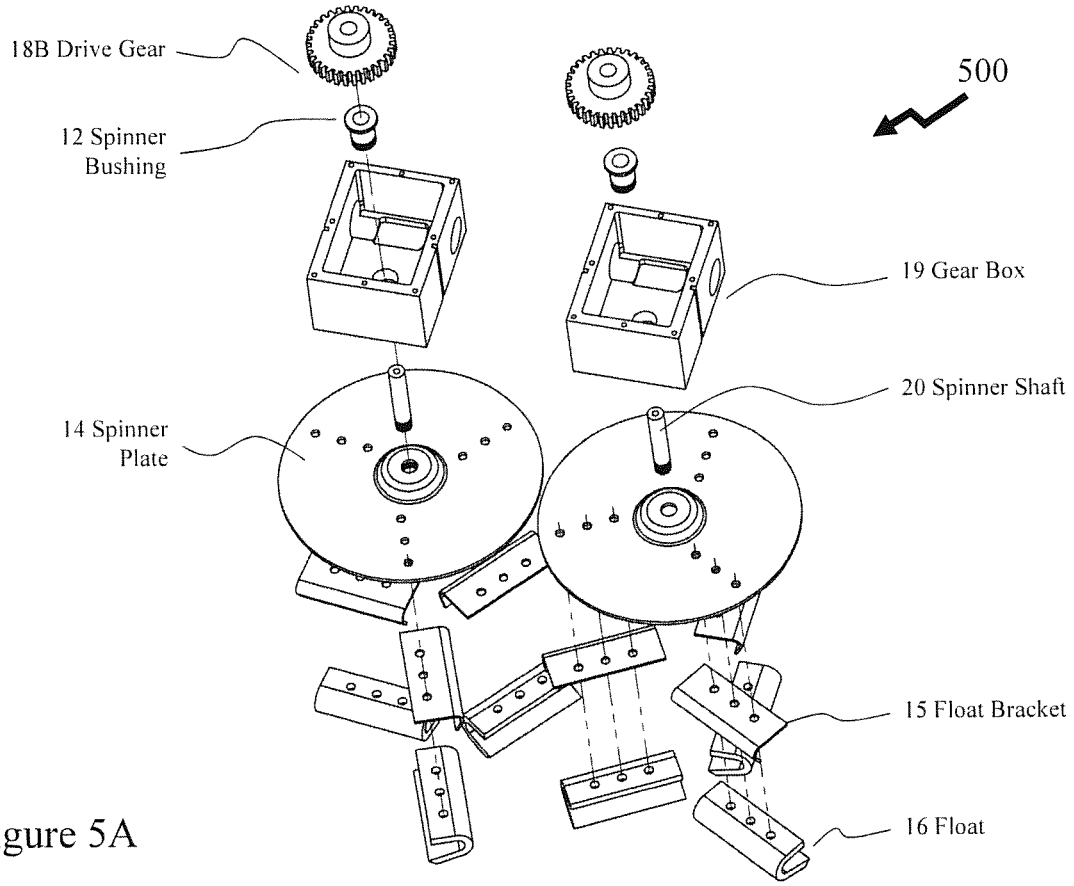
FIG. 5A depicts an exploded grouter assembly schematic for a grouting machine according to an embodiment of the invention.

Referring to FIG. 5A there is depicted a pair of exploded grouter assemblies 500 schematic for a grouting machine 100 according to an embodiment of the invention together with their associated spinner bushings 12, drive gears 18B; and gear boxes 19. Each grouter assembly 500 comprising a spinner plate 14 to which is attached the spinner shaft 20 on the upper side which engages the drive assembly via spinner bushing 12 and drive gear 18B. Attached to the lower side are a plurality of float brackets 15, in the embodiment depicted this being 3 float brackets 15. Attached to each float bracket 15 is a float 16. The float 16 is in contact with the surface being grouted and accordingly as its spinner assembly 500 rotates the float pushes grout into the joints, cracks, etc. within the surface being grouted, e.g. tiles. By an appropriate profile to the leading edge of the float 16 the grout is pushed forward and down as the spinner assembly 500 rotates. Further, by making the float 16 from a compliant material the spinner assembly 500 can dynamically adjust for surface height variations between adjacent regions of the surface. As depicted the floats 16 are attached to the float bracket 15 although within other embodiments of the invention these may be a single piece part. Not depicted within the Figures is an optional, replaceable sponge (squeegee) which is disposed along the rear of the machine in order to help contain the grout around the floats 16 and prevent it simply passing through the back base portion of the machine.

Within embodiments of the invention the float 16 may demountably or permanently attached to the float bracket 15. For ease of assembly the float bracket 15 is shown attached via holes in the spinner plate 14 such that the screws/bolts or attachment means are inserted from the top of the spinner plate 14 through it and into the float bracket 15. Float bracket may optionally have threaded portions allowing direct mounting to a bolt although it would evident that other means of attaching the float brackets 15 and optional sponge may be employed, such as t-slots for example. Alternatively, the float bracket 15 may be attached to the spinner plate 14 from below via nut and bolt or the spinner assembly may incorporated thread portions to directly receive a bolt. A similar arrangement may be employed for the optional replaceable sponge.

Spinner plate 14 may be manufactured from a variety of materials which may include, but not be limited, one or more of steel, stainless steel, aluminum, fiber reinforced plastic, plastic, etc. according to the design of the overall grouting machine 100 as discussed below which may vary from a small handheld unit to medium floor units and large floor units for example. Similarly, float bracket 15 may be manufactured from a variety of materials which may include, but not be limited, one or more of steel, stainless steel, aluminum, fiber reinforced plastic, plastic, etc. Float 16 may be manufactured from a range of compliant materials including, but not limited to, rubber, neoprene, synthetic rubber, plastic, vinyl, polyethylene etc. In other embodiments of the invention the floats 16 may be formed from non-compliant materials may include, but not be limited, one or more of steel, stainless steel, aluminum, fiber reinforced plastic, plastic, etc. Optionally, a spinner assembly 500 may be provided as a disposable element or as an assembly allowing replacement of the different elements to account for use, damage, etc.

Figure 5B:
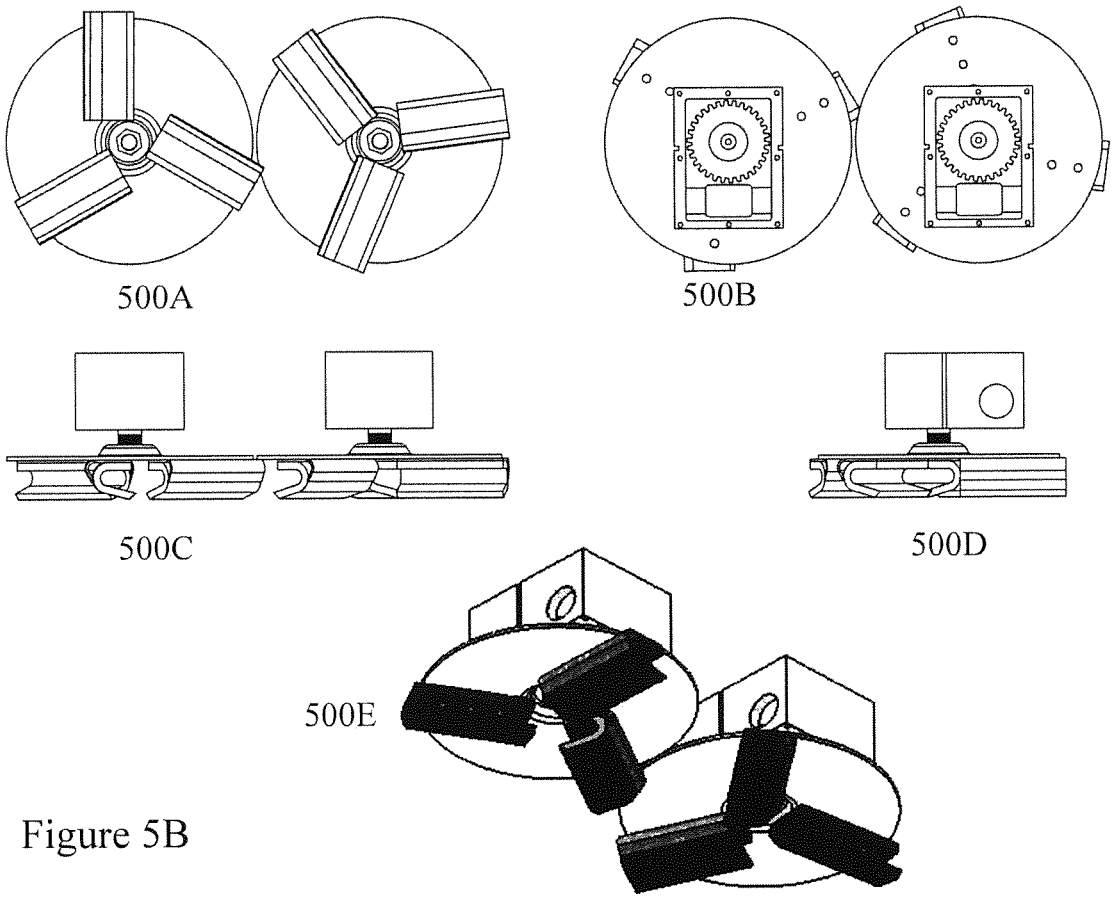
FIG. 5B depicts different views of the grouting assembly portion of a grouting machine according to an embodiment of the invention.

Now referring to FIG. 5B there are depicted different views of the assembled spinner assembly 500 together with the gear boxes 19 for the grouting assembly portions of a grouting machine 100 according to an embodiment of the invention. These views being:

Bottom view 500A;

Plan view 500B;

Front elevation 500C;

Side elevation 500D; and

Bottom perspective view 500E.

Figure 6A:
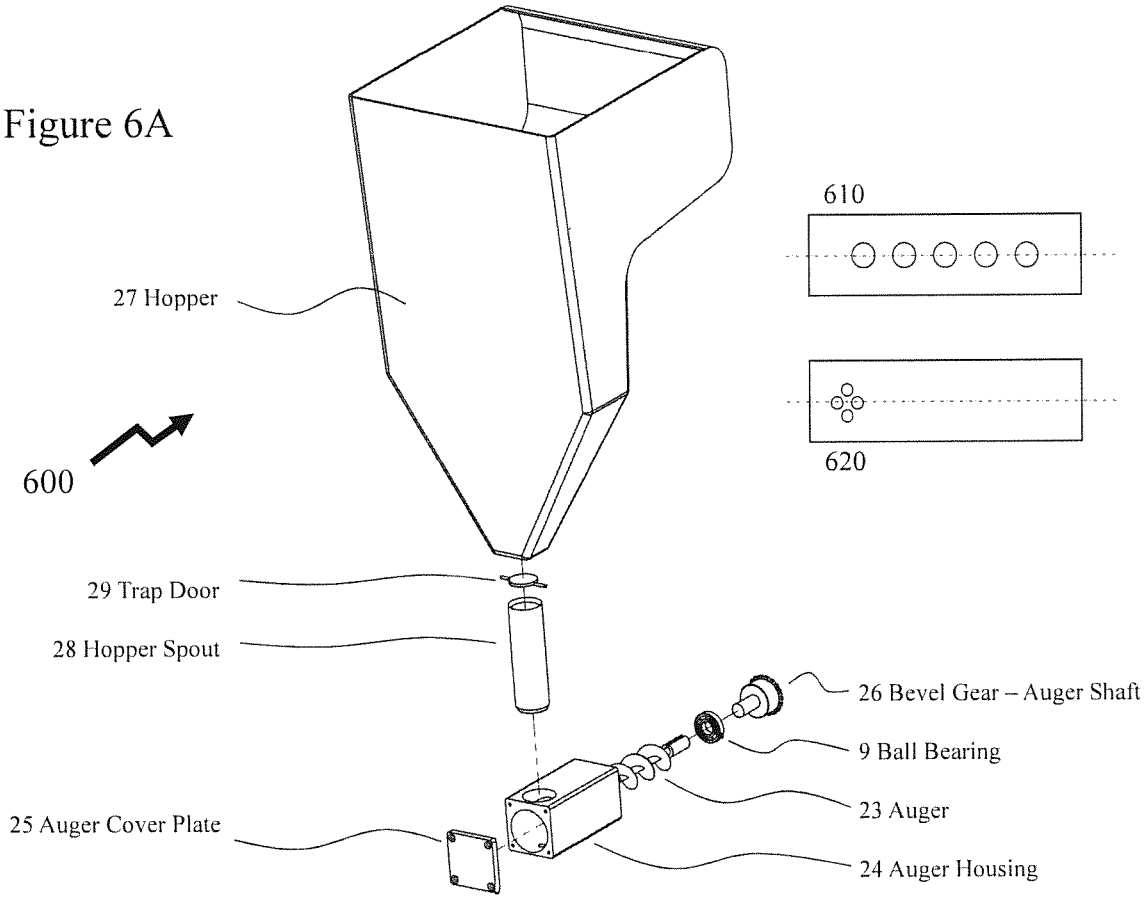
FIG. 6A depicts an exploded hopper assembly schematic for a grouting machine according to an embodiment of the invention.

Referring to FIG. 6A there is depicted an exploded hopper assembly 600 schematic for a grouting machine 100 according to an embodiment of the invention including the auger assembly as described above in respect of FIG. 4 and exploded drive assembly 400 schematic. Accordingly, the auger 23 is coupled to the motor, not shown for clarity, via a drive assembly including bevel gear and auger shaft 26 and ball bearing 9 and fits within an auger housing 24 which is terminated with auger cover plate 25. As discussed supra this may be modified in other embodiments of the invention wherein the auger is driven by a separate motor to the grouting assemblies. Auger cover plate 25 is depicted as removable to allow cleaning of the auger/grout dispensing elements of the grouting machine 100. It would be evident that this may be modified such that the auger and hopper are removed together within other embodiments of the invention allowing removal of the auger to allow for cleaning the auger, auger housing, and hopper. Optionally, auger cover plate 25 may be not present in other embodiments of the invention and the hopper and auger housing may be retained/removed through a set of captive thumb screws, for example.

An opening within the auger housing 24 couples to hopper spout 28 through which grout flows from hopper 27 when a trap door 29 is opened or may feed directly into the auger housing in other embodiments of the invention. Alternatively, the auger assembly may be disposed within the hopper assembly in line such that grout is drawn from the hopper and driven to the dispensing portion of the auger assembly. Within an embodiment of the invention the dispensing portion of the auger assembly may simply be a single hole and/or nozzle whereas in other embodiments of the invention it may an inline or clustered array of holes and/or nozzles as depicted in first and second images 610 and 620 respectively.

Figure 6B:
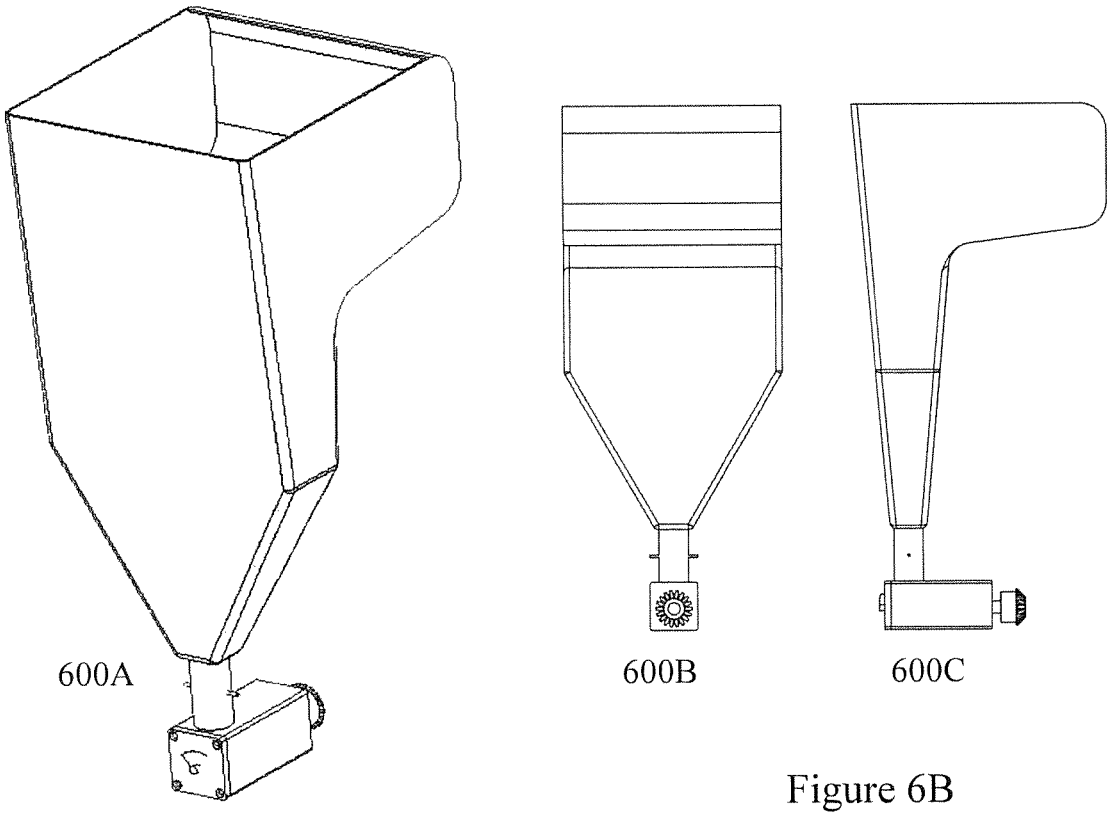
FIG. 6B depicts different views of the hopper portion of a grouting machine according to an embodiment of the invention.

Now referring to FIG. 6B there are depicted different views of the assembled hopper assembly 600 together with the auger assembly for a grouting machine 100 according to an embodiment of the invention. These views being:

Perspective view 600A;

Front elevation 600B, viewed from the drive end; and

Side elevation 600C.

Figure 7A:
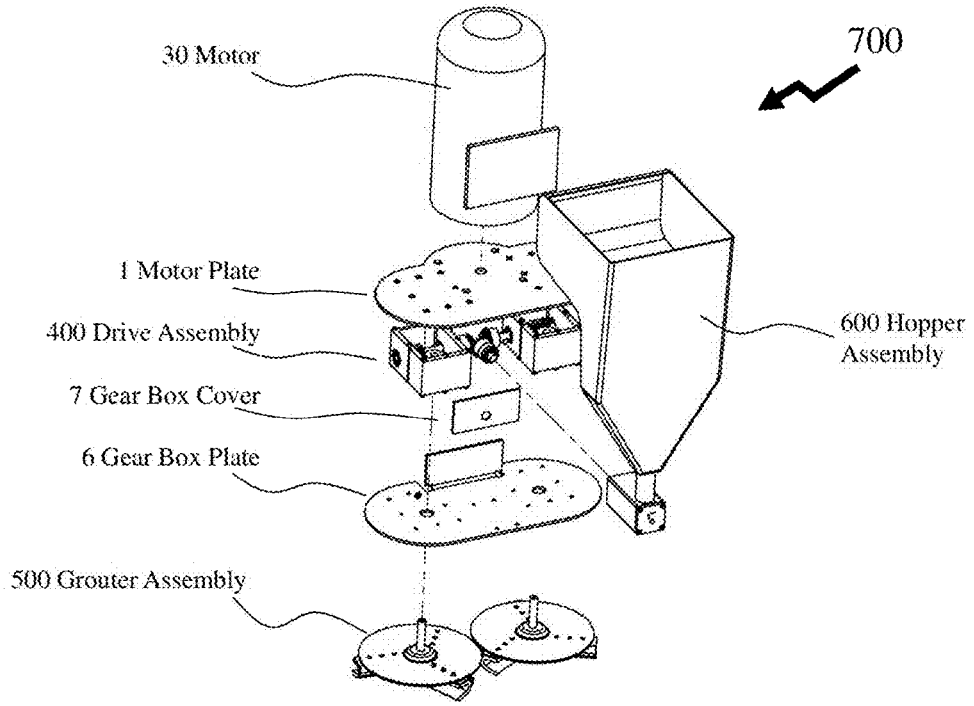
FIGS. 7A and 7B depict grouting machines according to embodiments of the invention.
Figure 7B:
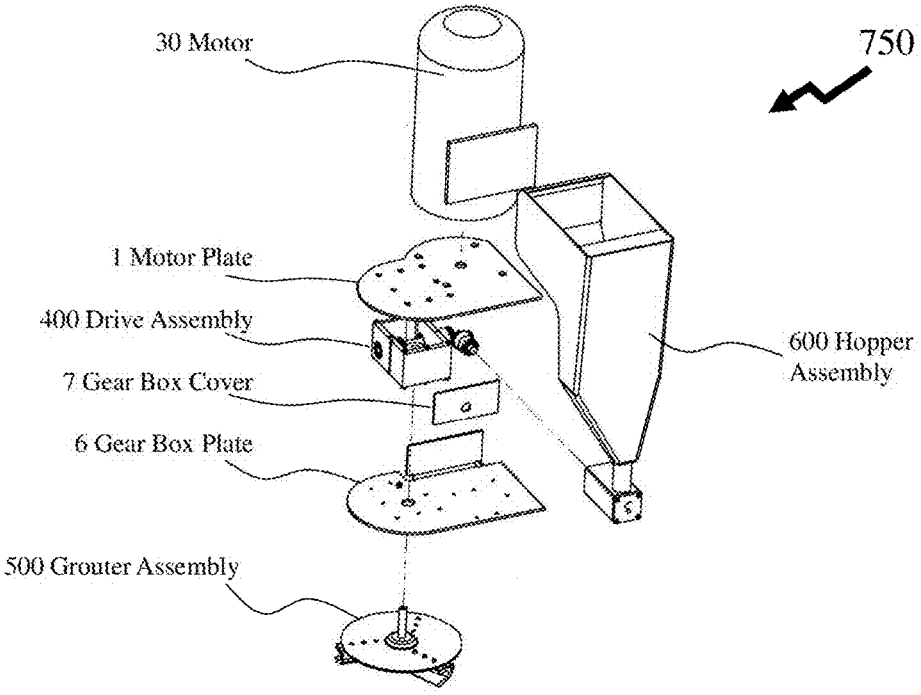

Referring to FIG. 7A there is depicted a first grouting machine 700 according to embodiments of the invention comprising motor 30, motor plate 1, drive assembly 400, gear box cover 7, gear box plate 6, hopper assembly 600, auger assembly, and a pair of grouter assemblies 500. Optionally, disposed at the rear of the machine or rear of each grouter assembly 500 a sponge may be provided for limiting grout passing through the grouter assemblies 500 to the rear of the machine. Similarly, other embodiments of the invention may include stabilizing wheels for the first grouting machine 700 when in use and/or transportation when the first grouting machine 700 is not in use. Omitted for clarity are cover of the first grouting machine 700 and a cover plate of the hopper assembly 600. In FIG. 7B there is depicted a second grouting machine 750 similarly comprising motor 30, motor plate 1, drive assembly 400, gear box cover 7, gear box plate 6, hopper assembly 600, but now with a single grouter assembly 500. Similarly omitted for clarity are cover of the second grouting machine 750 and a cover plate of the hopper assembly 600. First and second grouter machines 700 and 750 respectfully may represent, for example, handheld devices according to embodiments of the invention for use upon smaller areas than grouting machine 100 or may be smaller machines for use with a smaller, lighter handle which is demountably attached to either of the first and second grouter assemblies 700 and 750 respectfully. Optionally, a smaller, lighter handle may be permanently and/or pivotally attached to either of the first and second grouter assemblies 700 and 750 respectfully.

Figure 8:
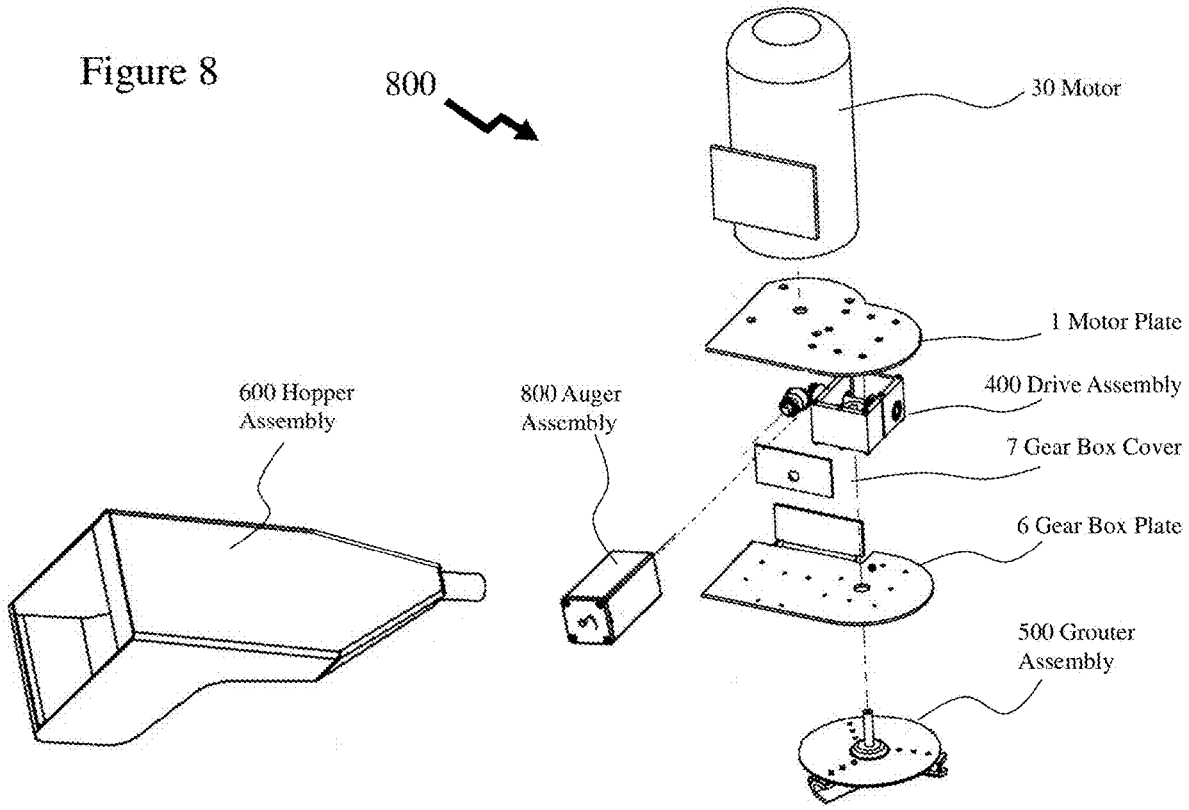
FIG. 8 depicts a grouting machine according to an embodiment of the invention.

Now referring to FIG. 8 there is depicted a grouting machine 800 according to embodiments of the invention comprising motor 30, motor plate 1, drive assembly 400, gear box cover 7, gear box plate 6, hopper assembly 600, and a grouter assembly 500. Omitted for clarity are cover of the first grouting machine 700 and a cover plate of the hopper assembly 600. Also depicted is auger assembly 800 to which the hopper assembly 600 is connected but now perpendicular to the remainder of the grouting machine 800. Accordingly, grouting machine 800 may be employed upon an angled or vertical surface to apply the grout. Similarly, first grouting machine 700 with a pair of grouter assemblies 500 may have the hopper assembly mounted at right angles to that depicted in first grouting machine 700 to provide dispensing of grout whilst the first grouting machine 700 is vertically positioned. Optionally, the auger assembly 800 and hopper assembly 600 may be pivotally mounted to the grouting machine allowing the orientation between the hopper assembly 600 and grouter assembly/assemblies to be varied.

Within embodiments of the invention the motor 30, and an additional auger motor where employed, may be provided by, for example, an electric motor including, but not limited to, brushed DC motor, brushless DC motor, induction motor, synchronous motor, single phase AC motor, and multiple phase AC motor. In some embodiments of the invention an electric motor may be driven via a power cord connecting the motor to an electrical socket and therein electrical mains. In other embodiments of the invention a DC battery based design may be employed, such as those employed within cordless power tools for example exploiting 10.5V, 12V, 18V, 19.2V, 20V, 24V, 36V or 40V battery designs. In other embodiments of the invention combustion motors exploiting fuels such as gasoline, paraffin, liquid petroleum gas, compressed butane, natural gas, etc. may be employed.

Within the embodiments of the invention described supra in respect of FIGS. 1B to 6B the diameter of the spinner assemblies may, for example, be 9" (225 mm), 10" (250 mm), 12" (300 mm), 15" (375 mm), or 18" (450 mm) such that the grouting machine 100 may provide grouting over relatively large areas such as an office floor, showroom floor, residential area etc. It would be evident that in embodiments of the invention the grouting machine 100 may be installed onto a ride on vehicle. Other embodiments of the invention may be designed to mount onto existing floor cleaning equipment or may be designed such that a common body, motor, handle assembly can be employed in a first configuration as a grouting machine and then in a second configuration as a polishing/cleaning machine. Within the embodiments of the invention presented supra in respect of FIGS. 7A and 7B handheld growing machines may exploit, for example, spinner assemblies of 3" (75 mm), 4" (100 mm)) and 6" (150 mm).

A grouting machine, such as that depicted and described with respect to grouting machine 100 in FIGS. 1B to 6B, may be operated by one user, who will control and guide the movement of the machine, using the handle assembly 300. The user closes a switch which activates a motor 30 which in turn powers the drive assembly 400. The drive assembly 400 drives the grouter assemblies 500 and the auger assembly. The assembly can easily be moved around on the flooring surface when the machine is turned on and the spinners are in motion.

The user must begin by mixing a desired amount of grout to fill the hopper 27. Once the hopper is full and the motor is plugged in, the machine can be started and the grouting process can begin. The user controls the trap door lever 3 to open the trap door 29, via cable 4, to allow the grout to fall into the auger housing 24 from the hopper 27 although in other embodiments of the invention the trap door 29 is removed and cable 4 provides control from a switch mounted to the handle to a separate auger motor that pushes/pulls the grout such that it is dispensed directly through an opening in the machine onto the floor. This allows the user to control the amount of grout landing on the floor, thus facilitating final cleanup. The grout in the auger housing is moved by an auger 23 to be pushed out of a hole directly on to the floor. As grout is dispensed, the grouter assemblies rotate, and the floats 16 press the grout between the tile crevices. With the assistance of the float keeping the grout mobilized between the spinner floats.

Grouter assemblies 500 are driven by the drive assembly 400 which works such that a bevel gear 5 is driven directly by the motor 30, which turns two bevel gears 8 opposite each other within grouting machine 100. Each bevel gear 8 drives one grouter assembly 800. Bevel gear 8 drives a shaft that in turn drives a worm gear set 18A/18B which drives spinner shaft 20 which is attached to the spinner plate 14. Three floats 16 are attached to each spinner plate 14 via float brackets 15 wherein these floats 16 press grout between tile crevices as they spin over the floor.

The worm gear setup is used to drive each spinner assembly opposite directions as well as to control speed, from the top view, the left assembly turns clockwise while the right turns counter-clockwise, therefore guiding the grout towards the center of the machine. This rotation may in other embodiments of the invention be reversed by the user, such as for example when the travel direction of the machine reverses during use. The auger assembly 800 is also driven by the motor 30. Bevel gear 26 is driven by bevel gear 5 and drives the auger 23 in some embodiments of the invention whereas in others the auger 23 may be driven by a separate auger motor in conjunction with an auger drive train. The auger 23 pushes grout dispensed from the hopper 27 to the floor. As depicted the grouter assemblies 500 and auger assembly 800 may be removed/dismantled allowing for clean-up whilst the hopper 27 may be flushed through with water. Similarly, the hopper assembly may also be demounted along with the auger housing to facilitate cleaning.

Within the process described in respect of FIG. 1A once the grout has been applied and the grout has been allowed to dry for a period of time then within the prior art the grouter would, using water and a soft, thick sponge, cleaning off the grout. It would be evident to one skilled in the art that a variant of the grouting machine 100 may be employed wherein the hopper 27 is replaced with a reservoir and spray nozzle and the grouter assemblies 500 with sponge pads such that a machine for cleaning off the grout may be provided to the grouter, consumer, contractor, builder etc. In this instance, for a discrete separate machine the user may have a lever for controlling the flow of cleaning fluid, water, etc. from the reservoir. Within another embodiment of the invention the hopper 27 and grouter assemblies 500 may be removed from the machine and replaced with reservoir and sponge pads. In other embodiments of the invention, the sponge pads may be replaced with porous manmade and/or natural materials including, but not limited to, cellulose wood fibers, foamed plastic polymers, low density polyether, polyester, and polymers derived from polyvinyl alcohol. In some embodiments of the invention other pads may be used including, for example, those with scouring type surfaces and/or buffing/polishing. In the instance of a small handheld unit once cleaned the grouter assemblies may be removed and replaced whilst the cleaning fluid/water is applied through a spray, nozzle, bottle, etc. discrete from the machine. Optionally, the hopper may be used as the reservoir.

In the embodiment of the invention wherein four or more grouter assemblies 500 are coupled to the motor 30 these may be driven such that each pair of adjacent grouter assemblies 500 are rotating in opposite directions. This, for example, may be mounted onto a ride-on vehicle allowing for large areas to grouted.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device comprising:

a first motor;

a drive assembly for coupling a drive shaft of the first motor to a first grouter assembly and a second grouter assembly;

the first grouter assembly coupled to the drive assembly to distribute and direct a predetermined material into a surface with which the first grouter assembly is in contact;

the second grouter assembly coupled to the drive assembly to distribute and direct the predetermined material into the surface with which the second grouter assembly is in contact; and an auger for feeding the predetermined material from a hopper to be dispensed in predetermined position relative to the first grouter assembly, the auger coupled to at least one of the first motor and a second motor via an auger drive assembly; wherein the second grouter assembly rotates in the opposite direction to the first grouter assembly.

2. The device according to claim 1, wherein the first grouter assembly comprises:

a spinner assembly comprising at least a plate and a shaft coupling the first grouter assembly to the drive assembly on a first side of the plate;

a plurality of float brackets attached in a predetermined manner to the other side of the plate from the shaft; and a plurality of floats, each float mounted to a float bracket and formed from a compliant material.

3. The device according to claim 2, wherein each float has a profile upon a leading edge of the float to push the predetermined material forward and downward as the float moves across the surface.

4. The device according to claim 2, wherein the plurality of floats are rigidly attached to the plurality of float brackets; and the plate with the plurality of float brackets and the plurality of floats is demountable from the device.

5. The device according to claim 2, wherein each float of the plurality of floats can be demountably attached to its respective float bracket of the plurality of float brackets.

6. The device according to claim 1, wherein the first grouter assembly may be removed from the device and replaced with a pad; and the pad is one or more of formed from a manmade material, formed from a natural material, has a surface for scouring, a surface for polishing and a surface for buffing.

7. The device according to claim 1, further comprising the hopper for storing the predetermined material, the hopper connected to at least one of the auger and an auger housing comprising the auger.

8. The device according to claim 7, wherein the hopper may be removed and replaced with a fluid reservoir and a fluid spray nozzle.

9. The device according to claim 1, further comprising a pad;

a fluid reservoir; and a fluid dispensing mechanism spray nozzle; wherein in a first change of configuration of the device:

the first grouter assembly attached to the device is replaced with the pad by demounting the first grouter assembly and mounting the pad; and the hopper attached to the device is replaced with the fluid reservoir and fluid spray nozzle; and in a second change of configuration of the device:

the pad when attached to the device is replaced with the first grouter assembly by demounting the pad and mounting the first grouter assembly; and the fluid reservoir and fluid spray nozzle attached to the device are replaced with the hopper.

10. The device according to claim 1, further comprising a pad; and a fluid spray nozzle; wherein in a first change of configuration of the device:

the first grouter assembly attached to the device is replaced with the pad by demounting the first grouter assembly and mounting the pad;

in a second change of configuration of the device:

the pad when attached to the device is replaced with the first grouter assembly by demounting the pad and mounting the first grouter assembly; and the hopper acts as a reservoir for the predetermined material when the first grouter assembly is attached to the device and as a reservoir for a fluid to be dispensed from the fluid spray nozzle when the fluid spray nozzle is attached to the device.

11. The device according to claim 1, further comprising:

one or more floats disposed relative to the first grouter assembly; wherein each float has a profile on a leading edge of the load such that as the first grouter assembly rotates any predetermined material is, pushed forwards and down by the one or more floats; and each float is formed from at least one of a porous material and a compliant material.

12. The device according to claim 1, further comprising two or more wheels disposed upon a lower surface of the device in predetermined relationship with the first grouter assembly; wherein the two of more wheels provide stabilization of the device in use.

13. The device according to claim 1, wherein the device is handheld device.

14. The device according to claim 1, further comprising a handle demountably attachable to the device; wherein the device is a handheld device.

15. The device according to claim 1, wherein the first motor and the drive assembly form part of an item of floor cleaning equipment to which the first grouter assembly, the hopper and the auger can be demountably attached.

16. The device according to claim 1, further comprising a pad; wherein the first grouter assembly comprises:

a spinner assembly comprising at least a plate and a shaft coupling the spinner assembly to the drive assembly on a first side of the plate;

a plurality of float brackets attached in a predetermined manner to the other side of the plate from the shaft; and a plurality of floats, each float mounted to a float bracket and formed from a compliant material;

the first grouter assembly is demountably attachable to the device; and the pad is demountably attachable to the device when the first grouter assembly is demountably detached from the device; and the pad has a surface disposed towards the surface when attached to the device which provides one of scouring, buffing and polishing.

17. The device according to claim 1, further comprising a second grouter assembly coupled to the drive assembly to distribute and direct the predetermined material into the surface with which the second grouter assembly is in contact;

a third grouter assembly coupled to the drive assembly to distribute and direct the predetermined material into the surface with which the third grouter assembly is in contact;

a fourth grouter assembly coupled to the drive assembly to distribute and direct the predetermined material into the surface with which the fourth grouter assembly is in contact;

another auger for feeding the predetemined material from a second hopper to be dispensed in predetermined position relative to the third grouter assembly and fourth grouter assembly, the another auger coupled to at least one of the first motor and the second motor via another auger drive assembly;

wherein the auger feeds the predetermined material from the hopper to the second grouter assembly;

the second grouter assembly rotates in the opposite direction to the first grouter assembly; and the third grouter assembly rotates in the opposite direction to the fourth grouter assembly.

18. A device comprising:

a first motor;

a drive assembly for coupling a drive shaft of the first motor to a first grouter assembly;

the first grouter assembly coupled to the motor via the drive assembly to distribute and direct a predetermined material into a surface with which the first grouter assembly is in contact;

an auger for feeding the predetermined material from a hopper to be dispensed in predetermined position relative to the first grouter assembly, the auger coupled to at least one of the first motor and a second motor via an auger drive assembly;

a pad;

a fluid reservoir; and a fluid spray nozzle; wherein in a first change of configuration of the device:

the first grouter assembly attached to the device is replaced with the pad by demounting the first grouter assembly and mounting the pad; and the hopper attached to the device is replaced with the fluid reservoir and fluid spray nozzle; and in a second change of configuration of the device:

the pad when attached to the device is replaced with the first grouter assembly by demounting the pad and mounting the first grouter assembly; and the fluid reservoir and fluid spray nozzle attached to the device are replaced with the hopper.

19. A device comprising:

a first motor;

a drive assembly for coupling a drive shaft of the first motor to a first grouter assembly;

the first grouter assembly coupled to the motor via the drive assembly to distribute and direct a predetermined material into a surface with which the first grouter assembly is in contact;

an auger for feeding the predetermined material from a hopper to be dispensed in predetermined position relative to the first grouter assembly, the auger coupled to at least one of the first motor and a second motor via an auger drive assembly;

a pad; and a fluid spray nozzle; wherein in a first change of configuration of the device:

the first grouter assembly attached to the device is replaced with the pad by demounting the first grouter assembly and mounting the pad;

in a second change of configuration of the device:

the pad when attached to the device is replaced with the first grouter assembly by demounting the pad and mounting the first grouter assembly; and the hopper acts as a reservoir for the predetermined material when the first grouter assembly is attached to the device and as a reservoir for a fluid to be dispensed from the fluid spray nozzle when the fluid spray nozzle is attached to the device.

20. A device comprising:

a first motor;

a drive assembly for coupling a drive shaft of the first motor to a first grouter assembly;

the first grouter assembly coupled to the motor via the drive assembly to distribute and direct a predetermined material into a surface with which the first grouter assembly is in contact;

an auger for feeding the predetermined material from a hopper to be dispensed in predetermined position relative to the first grouter assembly, the auger coupled to at least one of the first motor and a second motor via an auger drive assembly;

a pad; wherein the first grouter assembly comprises:

a spinner assembly comprising at least a plate and a shaft coupling the spinner assembly to the drive assembly on a first side of the plate;

a plurality of float brackets attached in a predetermined manner to the other side of the plate from the shaft; and a plurality of floats, each float mounted to a float bracket and formed from a compliant material;

the first grouter assembly is demountably attachable to the device;

the pad is demountably attachable to the device when the first grouter assembly is demountably detached from the device; and the pad has a surface disposed towards the surface when attached to the device which provides one of scouring, buffing and polishing.

* * * * *